US007492253B2

(12) United States Patent
Ollis et al.

(10) Patent No.: US 7,492,253 B2
(45) Date of Patent: Feb. 17, 2009

(54) SYSTEM FOR REPORTING AN ADVERSE CONDITION

(75) Inventors: Jeffrey D. Ollis, Dresher, PA (US); James A. Panacek, North Wales, PA (US)

(73) Assignee: General Instrument Corporation, Horsham, PA (US)

( * ) Notice: Subject to any disclaimer, the term of this patent is extended or adjusted under 35 U.S.C. 154(b) by 401 days.

(21) Appl. No.: 11/338,556

(22) Filed: Jan. 24, 2006

(65) Prior Publication Data

US 2007/0171044 A1 Jul. 26, 2007

(51) Int. Cl.
*G08B 21/00* (2006.01)

(52) U.S. Cl. ..... 340/540; 340/541; 340/628; 340/539.1; 340/539.14; 340/521; 340/522; 340/524; 340/531; 725/32; 725/81; 725/152

(58) Field of Classification Search ..... 340/540, 340/541, 628, 539.1, 539.14, 522, 524, 539, 340/521, 531, 14; 725/32, 81, 152
See application file for complete search history.

(56) References Cited

U.S. PATENT DOCUMENTS 4,796,018 A * 1/1989 Nakanishi et al. ..... 340/691.1
5,889,468 A * 3/1999 Banga ..... 340/628
5,973,603 A * 10/1999 Judy ..... 340/628
6,353,395 B1 * 3/2002 Duran ..... 340/691.1
6,583,720 B1 6/2003 Quigley
6,703,930 B2 3/2004 Skinner
7,342,488 B2 * 3/2008 Wolfe et al. ..... 340/500

OTHER PUBLICATIONS

U.S. Appl. No. 10/930,435, David Atwood.

* cited by examiner

*Primary Examiner*—Tai T Nguyen
(74) *Attorney, Agent, or Firm*—Larry T. Cullen

(57) ABSTRACT

A system for reporting the presence of an adverse condition is described. Adverse conditions include smoke, breaking glass and carbon monoxide. The system includes one or more detectors that sense the adverse condition. The system further includes a central controller that stores a plurality of messages that in turn include a plurality of vocal instructions. A subset of messages is selected based on the detector that sends an indication of the adverse condition to the central controller. The subset of messages is then transmitted to a plurality of audio detectors and audio devices that plays the received vocal instructions.

5 Claims, 3 Drawing Sheets

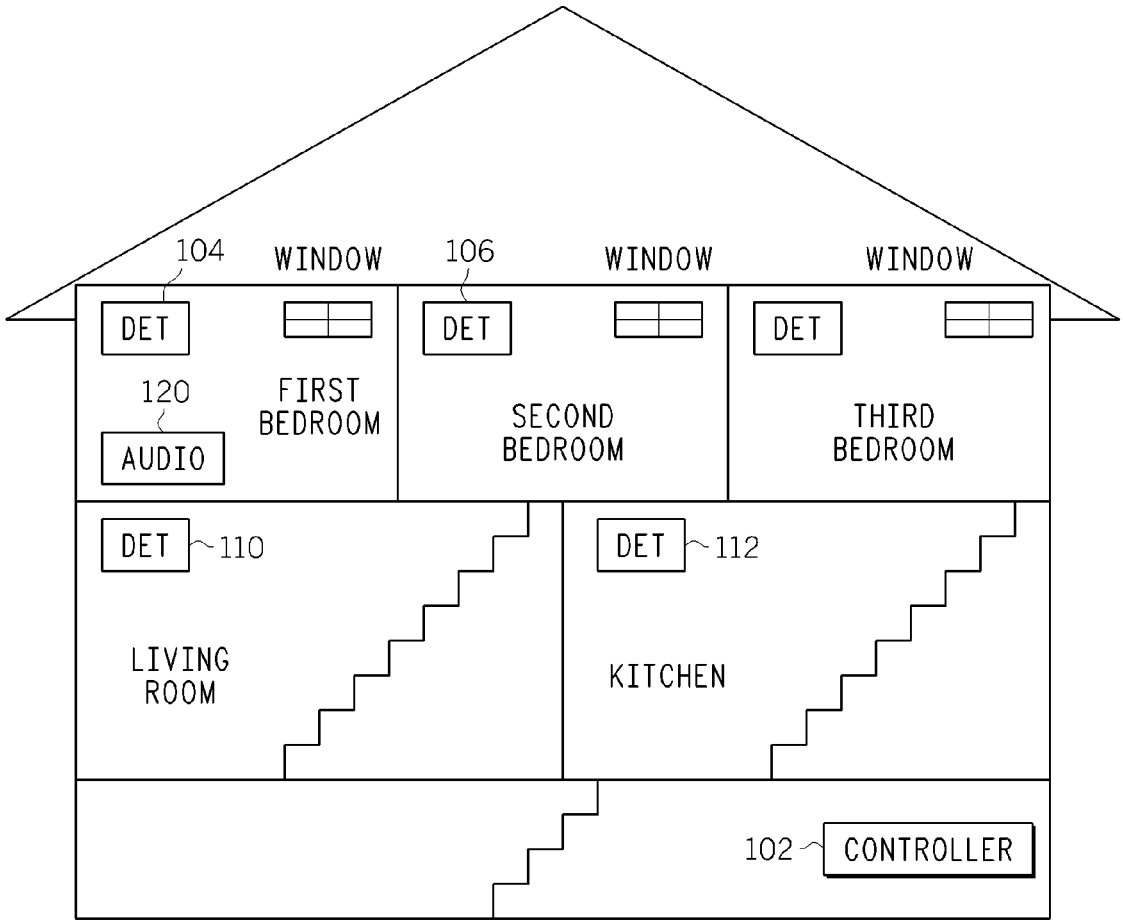
FIG. 1
FIG. 2
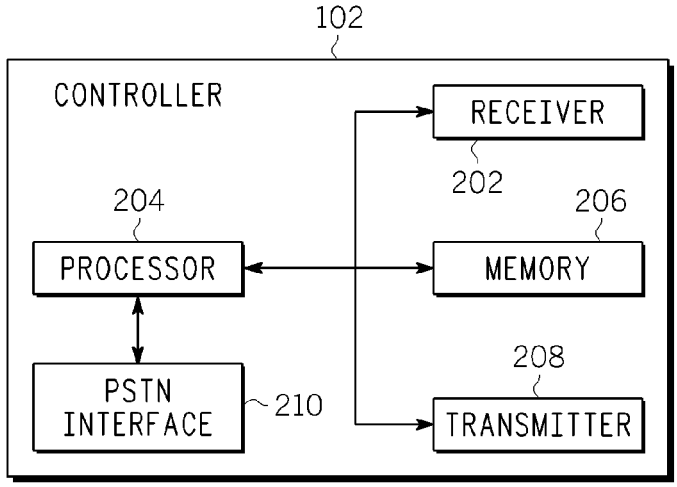

| | 305 SOURCE ADDR | 310 VOCAL INSTRUCTION | 315 DESTINATION ADDR |
|---|---|---|---|
| 320 | 123.456.789 | "FIRE! EXIT THE HOME USING THE FIRST STAIRWAY" | 978.654.321 |
| | ⋮ | ⋮ | ⋮ |
| 325 | 010.222.345 | "FIRE! EXIT THE HOME USING THE SECOND STAIRWAY" | 978.654.321 |
| | ⋮ | ⋮ | ⋮ |
| 330 | 133.679.134 | "FIRE! EXIT THE HOME THROUGH A WINDOW" | 978.654.321 |
| | | | |

300

SYSTEM FOR REPORTING AN ADVERSE CONDITION

FIELD OF THE INVENTION

The present invention relates to the field of smoke detectors and other safety and security systems, and more specifically, to providing specific instructions to a particular location.

BACKGROUND OF THE INVENTION

A home monitoring system is an important feature in any residential building. This system can provide a user with varied monitoring facilities. One such monitoring facility includes a fire monitoring system. Usually, to provide fire safety, the home monitoring system uses various smoke detectors installed at various locations in a house. A smoke detector detects presence of smoke at a location where it is mounted and then sounds an alarm. In order to ensure maximum safety, it is important that the smoke detector detects the smoke and sounds the alarm very early.

There are a number of different smoke alarm systems. One such system interconnects the smoke detectors together. These interconnected smoke detectors are mounted at different locations in the house. The interconnection is in the form of a hard-wire connection and enables one smoke detector to signal other smoke detectors when it detects smoke.

Another system issues vocal instructions on what do when smoke is detected. The recorded voice message is more effective than the alarm, especially for elderly people and children, and can guide people out of the house. However, the vocal smoke detector plays the recorded voice message only at the location where it is mounted. In this case, the recorded voice message may not be audible at other locations in the house. Moreover, the single voice message played by the vocal smoke detector may not pertain to the location of the smoke. In other words, the same voice message may not be applicable to different locations of the fire in the home. Hence, is not able to guide people out of the house effectively.

BRIEF DESCRIPTION OF THE FIGURES

The present invention is illustrated by way of example, and not limitation, in the accompanying figures, in which like references indicate similar elements, and in which:

FIG. 1 illustrates a home with a networked, vocal home monitoring system;

FIG. 2 is a block diagram of a controller in a home monitoring system;

Figures 3, 4:
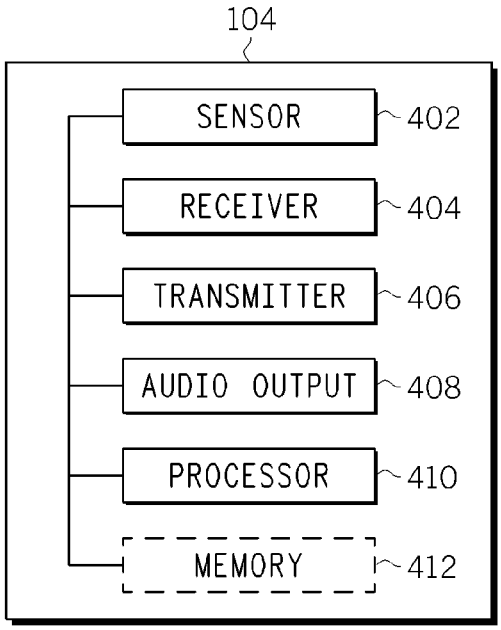
FIG. 3 is a database used in a home monitoring system.
FIG. 4 is a block diagram of a vocal smoke detector.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION OF THE EMBODIMENTS

In this document, relational terms such as first and second, and the like may be used solely to distinguish one entity or action from another entity or action without necessarily requiring or implying any actual such relationship or order between such entities or actions. The terms 'comprises,' 'comprising,' or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by 'comprises . . . a' does not, without more constraints, preclude the existence of additional identical elements in the process, method, article, or apparatus that comprises the element.

FIG. 1 illustrates an exemplary environment 100 where a home monitoring system is implemented. The exemplary environment 100 includes a home monitoring system for an illustrative home 101. The illustrative home 101 has a first bedroom, a second bedroom and a third bedroom all on a second floor; a living room and a kitchen on a first floor; a first staircase and a second staircase interconnecting the first and second floors and a third staircase interconnecting the first floor and a basement. The home monitoring system includes a controller or central hub 102, detectors 104, 106, 108, 110, and 112. In the illustrative system shown the detectors 104, 106, 108, 110, and 112 are smoke detectors. In various other illustrative systems, the home 101 may include a different number of detectors such as heat, motion, breaking glass, carbon monoxide etc. Detectors 104, 106, and 108 are mounted in the first, second and third bedrooms, respectively. Detector 110 is mounted in the living room and detector 112 is mounted in the kitchen. As shown in FIG. 1, the detectors 104, 106, 108, 110, and 112 are mounted at different locations throughout home 101. In one illustrative system, detectors 104, 106, 108, 110 and 112 communicate with controller 102. In the illustrative system shown in FIG. 1, controller 102 and detectors 104, 106, 108, 110 and 112 communicate through a wireless network. Examples of the wireless network include, but are not limited to, a ZigBee™ wireless network, a Bluetooth wireless network, and a wireless fidelity (Wi-Fi) network. In another illustrative system, the communication between controller 102 and detectors 104, 106, 108, 110, and 112 takes place through wired connections by using fiber-optic cables, copper conductor cables, and the like. Controller 102 receives a signal from one of the detectors 104, 106, 108, 110 and 112 that detects smoke in the room it is located. Controller 102 then transmits one or more message to the other detectors 104, 106, 108, 110, and 112 at other locations in the home 101. This in turn causes the other detectors 104, 106, 108, 110, and 112 to issue vocal instruction to the occupants on a preferred route to exit the home. In an alternative system, controller 102 transmits a signal to an audio device 120, such as an alarm clock, television, stereo, land-line telephone, mobile telephone, a personal computer or laptop computer or a personal digital assistant that reports the emergency to the occupants.

FIG. 2 is a block diagram of an illustrative controller 102. Controller includes a receiver 202, a processor 204, a memory 206, and a transmitter 208. When a detector senses an adverse condition where it is located, it transmits a problem signal to controller 102. Receiver 202 receives the problem signal and forwards it to processor 204. Processor 204 then requests a sub-set of messages stored in memory 206 based on a characteristic or portion of the problem signal sent by the detector. In such an illustrative system processor 204 forms its query of memory 206 so that it includes a Media Access Control (MAC) or Internet Protocol (IP) address of the detector that sent the problem signal.

Memory 206 stores a plurality of messages indexed by the various addresses of the detectors that transmit problem signals. In one example, the messages stored in the memory 206 include vocal instructions recorded into the controller 102 by a user. If the system is to be used in a home with children, it can be additionally beneficial to have one of the parents record the vocal instructions so that in a true emergency the children will hear the familiar voice of the parent and not panic in order to follow the instructions providing the best route to exit the home. The vocal instructions may be recorded using various known techniques for recording. These vocal instructions provide directions to exit the home 101 in the event of an emergency. The multiple vocal instructions provide many alternative directions for exiting the home 101.

In one illustrative system, processor 204 requests one or more messages from memory 206. In this system processor 204 formats its request for messages from memory 206 based on the address of the detector that sent the problem signal. Processor 204 then forwards the one or more messages returned by memory 206 to transmitter 208. Transmitter 208 then transmits the one or more messages to one or more detectors 104, 106, 108, 110 and 112 and audio device 120. Once some or all of the detectors 104, 106, 108, 110, and 112 and audio device 120 receive the one or messages, they play the vocal instructions which typically includes directions on how best to exit home 101. For example, in the event of an emergency, the controller 102 is able to place a call to a user on his/her mobile phone, and play a pre-recorded voice message, informing the user about the emergency.

In one illustrative system, the receiver 202 and the transmitter 208 are integrated into a transceiver. The transceiver receives and transmits signals wirelessly or via wired connections. In another illustrative system, a PSTN interface 210 is included in controller 102 to enable communication with the one or more audio devices. For example, consider a case where at least one audio device is a PSTN phone, and the controller 102 is connected to it through a hybrid 2/4 wire used in the register jack (RJ-11) port of the phone. On detecting an emergency situation or adverse condition, controller 102 can signal the PSTN phone to ring and play out vocal instructions upon receipt of the call.

In another illustrative system the PSTN interface 210 is used to automatically place a call to a monitoring service, such as an alarm company, in the event any detector reports the presence of smoke or some other adverse condition at its location. In this system, memory 206 stores a relevant, pre-recorded vocal instruction, for an emergency situation such as a fire. The PSTN interface 210 is then able to retrieve the special pre-recorded vocal instruction from memory 206 via the processor 204, and play it during the call.

FIG. 3 is an exemplary database 300 that may be stored in memory 206. It should be noted that FIG. 3 is merely a representation of the how the data is organized and other implementations and representations may be used by those of ordinary skill in the art. Database 300 includes three columns 305, 310 and 315. Column 305 holds a plurality of source addresses from where problem signals are received. Column 310 holds a plurality of vocal instructions. Column 315 holds a plurality of destination addresses to where the vocal instructions in column 310 are to be sent.

Database 300 also includes a plurality of rows arranged into subsets 320, 325 and 330. It should be noted that more row subsets may be used in a particular implementation but only two are shown in FIG. 3 for clarity. Each subset 320 and 325 shares the same source address in column 305. Thus when processor 204 queries memory 206 using a source address 123.456.789 that is associated with a particular detector, memory 206 responds by returning all the vocal instructions in column 310 and destination addresses in column 315 from subset 320. Column 305 in subset 330 has an address that is not associated with a single detector. The source address in subset 330 is generated by processor 204 when it receives problem signals from two or more detectors at substantially the same time as will be described in more detail later.

FIG. 4 is a block diagram of one example of detector 104. Detector 104 includes a sensor 402, a receiver 404, a transmitter 406, an audio output circuit 408 and a processor 410. Sensor 402 detects an adverse condition, such as smoke, motion or breaking glass in the room where it is placed and generates an output signal. Processor 410 receives the output signal from sensor 402 and generates and forwards a problem signal to transmitter 406. Transmitter 406 formats the problem signal and transmits it to controller 102. Controller 102 then broadcasts, multicasts or unicasts one or more messages as previously described.

Detector 104 then receives one or more messages from controller 102 via receiver 404. Receiver 404 forwards the received messages to processor 410. Processor 410 converts the vocal instructions from the messages into a format for audio output. Examples of the types of processing performed by processor 410 include decoding, decrypting and D/A conversion. The properly formatted data is then output to audio output 408 where it is played for the user.

If detector 104 is not designed to provide vocal instructions but is instead designed to detect an adverse condition and generate a problem signal, receiver 404 and audio output 408 may be omitted. In addition, one illustrative example for audio device 120 includes receiver 404, audio output 408 and processor 410. Audio device does not need sensor 402 to detect an adverse condition nor transmitter 406 to transmit a problem signal as that is not its purpose.

An alternative implementation of detector 104 is also shown in FIG. 4. In this implementation detector 104 includes memory 412 (shown in dashed lines). Memory 412 is implemented in detector 104, and other detectors, in home monitoring systems that do not use a central controller 102. In such a system, there is no controller 102 to receive the problem signals unicast from one or more detectors 104, 106, 108, 110 and 112. Also, there is also no controller 102 to in turn unicast, multicast or broadcast messages to each detector 104, 106, 108, 110 and 112 and audio device 120 providing different sets of vocal instructions depending on the location of the fire. In this alternative system, each detector 104, 106, 108, 110 and 112 broadcasts a problem signal to every other detector 104, 106, 108, 110 and 112 and audio device 120 in the home. The problem signal is generated and transmitted using sensor 402, processor 410 and transmitter 406 as previously described. Each detector 104, 106, 108, 110 and 112 and audio device 120 receives the broadcast problem signal via receiver 404 and independently determines the source address of the problem signal via processor 410 as previously described. Processor 410 queries memory 412 and memory 412 responds by returning one vocal instruction that is then output by audio output circuit 408. As an example, if detector 108 receives a problem signal from detector 110, detector 108 will select the vocal instructions that instruct the third bedroom occupants to exit the home via the second staircase and the back door through the kitchen.

Memory 412 holds a modified database to that shown in FIG. 3. Since each detector is not transmitting vocal instructions, column 315 may be omitted. In addition, each subset 320, 325 and 330 may contain only one row of data in columns 305 and 310. Thus, detector 104 only outputs one message when a problem signal is received from a particular detector or set of detectors.

Figure 5:
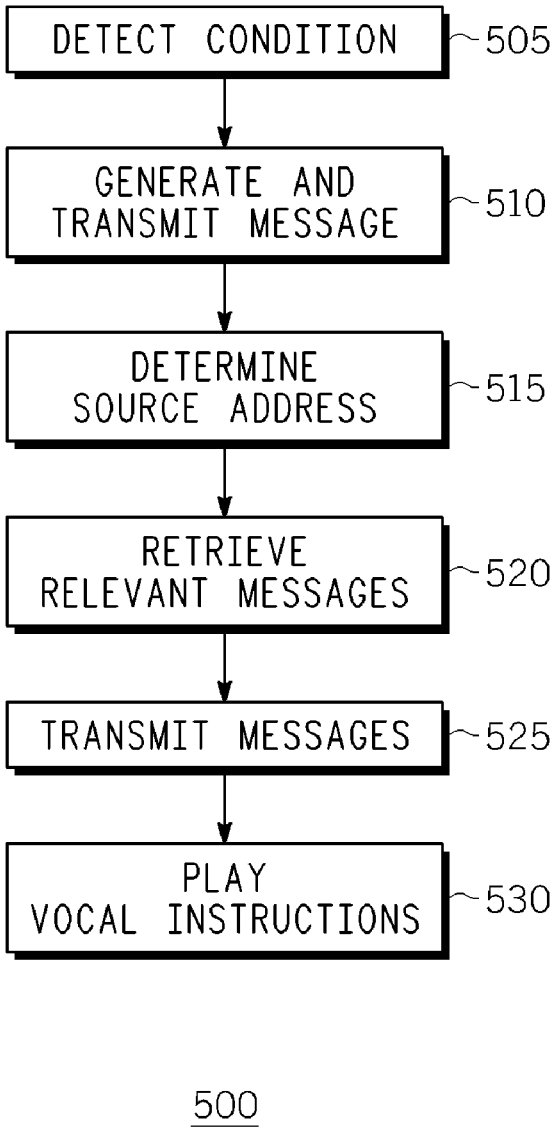
FIG. 5 is a flowchart for a process for operating a home monitoring system.

FIG. 5 shows a flowchart for a process 500 to disseminate instructions in case of an emergency. The process begins at step 505 when one or more detectors 104, 106, 108, 110 and 112 detect an adverse condition such as the presence of smoke. The one or more detectors generate one or more problem signals and forward them to controller 102 at step 510. Once controller 102 has received the problem signals, processor 204 determines the source address of the messages at step 515.

Once the source addresses have been determined, processor 204 generates a request for specific vocal instructions from memory 206 and memory 206 responds by returning the requested vocal instructions and destination addresses at step 520. At step 525, processor 204 forwards the vocal instructions to transmitter 208 where the vocal instructions are transmitted to some or all of the detectors 104, 106, 108, 110 and 112 and audio device 120 in messages. Each detector and audio device receives its vocal instructions via the destination address retrieved from column 515 from memory 206. At step 550 the audio detectors and/or devices play their respective vocal instructions.

The intercommunication between the controller 102 and various detectors 104, 106, 108, 110, and 112 and audio device 120 may be explained in conjunction with various illustrative systems. As an example, detectors 104, 106, 108, 110, and 112, are smoke detectors communicating with the controller 102 in the home monitoring system. Each detector 104, 106, 108, 110, and 112 is constructed as shown in FIG. 4 and can play a message that provides a smoke alert and vocal instructions on an optimum way to exit the home. Thus, when the detector 110 detects smoke in the living room, it transmits a problem signal to the controller 102 through a communication network. Receiver 202 receives the problem signal from the detector 110. Processor 204 uses the address (such as a MAC or IP address) of detector 104 to form a query that is then sent to memory 206. Memory 206 responds by returning a plurality of messages that include vocal instructions and destination addresses. Processor 204 then forwards the one or more messages to transmitter 208 that in turn transmits the selected messages to the respective detectors 104, 106, 108, 110, and 112 and audio device 120. Upon receiving the selected message, detectors 104, 106 and 108 and audio device 120 play the vocal instructions that provide directions to exit the home by using the second staircase and going out the backdoor (attached to the kitchen but not shown). Detector 110 will play a message telling the occupants the fire is in the living room and to exit using the nearest available exit (e.g., the front door attached to the living room or a window (not shown)). Detector 112 will play a message telling the occupants to exit out the back door attached to the kitchen (not shown). This keeps the occupants in the bedrooms and the kitchen away from the fire in the living room so as to maximize their safety while exiting the home.

In a similar fashion, if detector 112 in the kitchen detects smoke, controller 102 will forward different messages. Messages will be sent to detectors 104, 106 and 108 and audio device 120 that include vocal instructions telling the occupants to exit the home using the first stairwell and the front door (attached to the living room but not shown). Likewise, occupants in the living room will be told to exit the home through the front door via detector 110 while occupants in the kitchen will be told to exit using the safest available exit via detector 112.

In yet another example, if detectors 110 and 112 detect smoke in the living room and the kitchen at substantially the same time, they will each forward problem signals to controller 102. Since processor 204 receives two problem signals at substantially the same time, it must generate a unique data point to form its query of memory 206. One way to do this is to add the source addresses together. Of course it should be noted that any other number of methods may be practiced to generate a unique number from two or more source addresses. Referring to FIG. 3, if controller 102 receives problem signals from source address 123.456.789 and source address 010.222.345 at substantially the same time, it will recognize this fact and add the two source address together to generate the number 133.679.134. Processor 204 queries memory 206 using this number.

Memory 206 responds by returning the vocal instructions in column 310 and destination addresses in column 315 from subset 330. Processor 204 then transmits the vocal instructions using the various destination addresses. Detectors 104, 106 and 108 and audio device 120 play the vocal instructions that provide directions to exit the respective bedrooms via the windows in the bedrooms because it is presumed that the fire may be large enough to be in both the living room and the kitchen. Thus, exiting via the first or second stairways may actually bring the occupants closer to the fire and put them in jeopardy. In similar fashion, detectors 110 and 112 will play vocal instructions telling the occupants to exit each room using the safest available exit.

The above systems and methods also allow for dynamic presentation of vocal instructions. For example, suppose a fire begins in the living room and is detected by detector 110 at time to. Controller 102 will forward messages to detectors 104, 106 and 108 and audio device 120 at time $t_1$. Detectors 104, 106 and 108 and audio device 120 will play vocal instructions telling the occupants of the respective bedrooms to exit the home via the second staircase and back door attached to the kitchen as previously described at time $t_2$. If later the fire spreads into the kitchen, detector 112 will then begin transmitting messages to controller 102 at time $t_3$. Meanwhile controller 102 will continue to receive messages from detector 116 so that controller 102 will receive messages from both detectors 110 and 112 substantially at the same time at time $t_4$. Controller 102 will then transmit different messages to detectors 104, 106, 108 and audio device 120 at time $t_5$. At time $t_6$ the detectors 104, 106, 108 and audio device 120 will play a different vocal message telling the occupants of the respective bedrooms to exit the home via the windows and thereby avoid the fire on the first floor.

The above systems may also be implemented with non-vocal detectors. For example, the first bedroom does not need a vocal detector. Instead, detector 104 may simply detect a problem and transmit a problem signal to controller 102 or the audio detectors 104, 106, 108, 110 and 112 and audio devices 120 directly in the home. Audio device 120 receives either the problem signal from detector 104 or a message from controller 102 and plays the correspondingly appropriate vocal instructions to the occupants.

While the above systems and methods have been described with specific details above, it is understood that those of ordinary skill in the art may implement similar systems and methods with slightly varying details. For example, the functional blocks shown in FIGS. 2 and 4 may be implemented as discrete semiconductor packages or combined into one general purpose processor, ASCI or programmable device. In like fashion, messages output by memory 206 and 412 may be directly forwarded to transmitter 208 or 406, respectively, without passing through processors 204 and 410.

In yet another alternative system, PSTN interface 210 in FIG. 2 is replaced with an alternative WAN interface. Examples of such a WAN interface include an Internet or World Wide Web interface. In this exemplary system, memory 206 stores audio and/or text messages that can be output to either to a device in the home, such as a PC or wireless PDA, or to a third party security system, via either a wired or wireless link, as previously described.

The process shown in FIG. 5 may be implemented in a general, multi-purpose or single purpose processor. Such a processor will execute instructions, either at the assembly, compiled or machine-level, to perform that process. Those instructions can be written by one of ordinary skill in the art following the description of FIG. 5 and stored or transmitted on a computer readable medium. The instructions may also be created using source code or any other known computer-aided design tool. A computer readable medium may be any medium capable of carrying those instructions and include a CD-ROM, DVD, magnetic or other optical disc, tape, silicon memory (e.g., removable, non-removable, volatile or non-volatile), packetized or non-packetized wireline or wireless transmission signals.

What is claimed is:

1. A controller in a home monitoring system, the controller comprising:

a receiver that receives a first problem signal from a first detector during a first condition and a second problem signal from a second detector during a second condition;

a processor coupled to the receiver that receives the first problem signal during the first condition from the receiver and determines a location of the first detector and receives the second problem signal from the receiver and determines a location of the second detector during the second condition;

a memory coupled to the processor that stores a plurality of messages, and forwards a first subset of messages from the plurality of messages to the processor when it receives a first request that includes the location of the first detector from the processor and forwards a second, different subset of messages from the plurality of messages to the processor when it receives a second request that includes the locations of both the first detector and the second detector; and a transmitter coupled to the memory for transmitting the first subset of messages during the first condition and transmitting the second subset of messages during the first and second condition.

2. The controller of claim 1, wherein the receiver and transmitter are integrated together into a transceiver.

3. The controller of claim 2, wherein the transceiver receives and transmits signals wirelessly.

4. The controller of claim 2, wherein the transceiver receives and transmits signals via wired connections.

5. The controller of claim 1, wherein the plurality of messages stored in the memory include a plurality of vocal directions for exiting a building.

* * * * *